US005537197A

United States Patent [19]

Fujishiro et al.

[11] Patent Number: 5,537,197

[45] Date of Patent: Jul. 16, 1996

[54] ROTARY DEVELOPING DEVICE FOR IMAGE FORMING APPARATUS

[75] Inventors: Takatsugu Fujishiro, Tokyo; Minoru Suzuki, Yokohama; Noriyuki Kimura, Kawasaki, all of Japan

[73] Assignee: Ricoh Company, Ltd., Tokyo, Japan

[21] Appl. No.: 227,347

[22] Filed: Apr. 14, 1994

[30] Foreign Application Priority Data

Apr. 15, 1993 [JP] Japan ..... 5-111179

[51] Int. Cl.[6] ..... G03G 15/01

[52] U.S. Cl. ..... 355/326 R; 355/260

[58] Field of Search ..... 355/200, 210, 355/245, 260, 326 R, 327; 222/DIG. 1

[56] References Cited

U.S. PATENT DOCUMENTS

| | | | |
|---|---|---|---|
| 4,697,915 | 10/1987 | Hayashi et al. | 355/327 |
| 4,743,938 | 5/1988 | Ohno | 355/327 |
| 4,782,360 | 11/1988 | Iwamoto et al. | 355/326 R |
| 4,922,301 | 5/1990 | Katoh et al. | 355/326 R X |
| 5,040,031 | 8/1991 | Hayashi et al. | 355/326 R |
| 5,162,859 | 11/1992 | Hirono et al. | 355/327 X |
| 5,198,866 | 3/1993 | Kimura et al. | 355/326 R |
| 5,258,819 | 11/1993 | Kimura et al. | 355/326 R |

*Primary Examiner*—Sandra L. Brase

*Attorney, Agent, or Firm*—Oblon, Spivak, McClelland, Maier & Neustadt

[57] ABSTRACT

A rotary developing device for an image forming apparatus includes a plurality of rotary developing units accommodating a powder developer and being supported around a common axis, and a plurality of toner cartridges corresponding to the plurality of rotary developing units for supplying toner to the plurality of rotary developing units. Each rotary developing unit is moved to a developing position facing a latent image carrier by the rotation about the common axis and an electrostatic latent image formed on the latent image carrier is developed. The plurality of toner cartridges are connected with the plurality of rotary developing units so as to rotate together, and a toner outlet of the toner cartridge is disposed such that the toner is supplied to the respective rotary developing unit by the force of gravity on the toner accommodated in the respective toner cartridge at the time of rotational movement of the toner cartridge.

18 Claims, 8 Drawing Sheets

ROTARY DEVELOPING DEVICE FOR IMAGE FORMING APPARATUS

BACKGROUND OF THE INVENTION

1. Field of the Invention

The present invention relates to a rotary developing device installed in a copier, printer, facsimile transceiver or similar photographic image forming apparatus which is electrostatically formed on an image carrier. More particularly, the invention is concerned with a toner supplying system suitable for use in the rotary developing device which has a plurality of rotary developing units.

2. Description of the Related Art

Recently, there has been a requirement for copying machines which can perform copying of both black-and-white images and a color images in accordance with the color of documents.

In a color electrophotographic copier, for example, a latent image carrier charged in a predetermined polarity is exposed by light rays. Electrostatic latent images reproduced in different color are thus formed on the latent image carrier. The respective electrostatic latent images are developed by toners of different colors. Each toner image is transferred to the same transfer sheet so as to obtain a color image.

In a full color electrophotographic copier, for example, respective color electrostatic latent images are formed on a latent image carrier by the exposure of color-resolved light. The respective color electrostatic latent images are each developed by a toner having a color complementary to the color-resolved light. These toner images are transferred onto the same transfer sheet so as to obtain a multiple-color image. Toner images for the different colors may also be duplicated onto respective different transfer sheets so as to obtain mono-color images.

In the above stated image forming apparatus, it is necessary that respective electrostatic latent images formed on the latent image carrier are developed by respective toners of different colors.

A rotary developing device for an image forming apparatus and used to develop the electrostatic latent images is commonly known. In the rotary developing device, there are a plurality of rotary developing units for developing or visualizing the electrostatic latent images with respective toner for different colors. The plurality of rotary developing units is rotatably supported around a common rotational axis. Respective rotary developing units of the plurality of rotary developing units are selectively moved to a developing position facing to the latent image carrier. Respective electrostatic latent images on the latent image carrier are developed by respective toner for different colors to produce images.

Toner is consumed during the process and it is necessary to supply toner to the respective rotary developing units. The following method for supplying toner to the rotary developing units is commonly known:

A toner cartridge which is a container for toner is fixedly arranged in a corresponding rotary developing unit, and is separated from the rotary developing unit. Respective rotary developing units are each connected to the toner cartridges by a resilient cylinder. A toner conveying member in the form of a screw is formed in each resilient cylinder. The toner conveying member is rotated so as to supply toner from the respective toner cartridge to the corresponding rotary developing unit.

Another method for supplying a toner to the rotary developing units is also commonly known as follows:

Toner cartridges are rotatably supported in the plurality of rotary developing units, and are unitary with the rotary developing units. Respective rotary developing units are connected to the toner cartridges by a separate toner conveying member. The toner conveying member is rotated so as to supply a toner from each respective toner cartridge to the corresponding rotary developing unit.

However, in the conventional method for supplying the toner to the rotary developing units, the toner in each toner cartridge is conveyed and supplied to the respective rotary developing unit by the toner conveying member. It is thus necessary to provide the toner conveying member and a driving member for driving the toner conveying member. The rotary developing apparatus is thus large, complex and expensive. Moreover, when the toner is conveyed by the toner conveying member, the toner is subjected to large mechanical forces and is rapidly deteriorated thereby.

SUMMARY OF THE INVENTION

It is, therefore, an object of the present invention to provide a rotary developing device for an image forming apparatus in which the structure of the rotary developing device can be reduced in size and simplified.

It is another object of the present invention to provide a rotary developing device for an image forming apparatus which is capable of reducing the cost of the apparatus.

It is another object of the present invention to provide a rotary developing device for an image forming apparatus in which the toner is not rapidly deteriorated by the moving force of a toner conveying member.

According to one feature of the invention, the above end of the objects are achieved by a rotary developing device for an image forming apparatus having a latent image carrier. The device comprises a plurality of rotary developing units supported so as to rotate about a common axis so that each of the rotary developing units can be rotated to face the latent image carrier to develop an image on the latent image carrier. A plurality of toner cartridges are connected to the plurality of rotary developing units so as to supply toner to the rotary developing units. Each of the toner cartridges includes a toner outlet through which toner can flow to reach a respective one of the rotary developing units. Each of the toner outlets is also disposed on a respective one of the toner cartridges such that toner in the respective toner cartridges is discharged therefrom and through the respective toner outlet by gravity acting on the toner when the plurality of toner developing units is rotated about the common axis.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the rotary developing device of the invention are explained herein with reference to the accompanying drawings.

Figure 1:
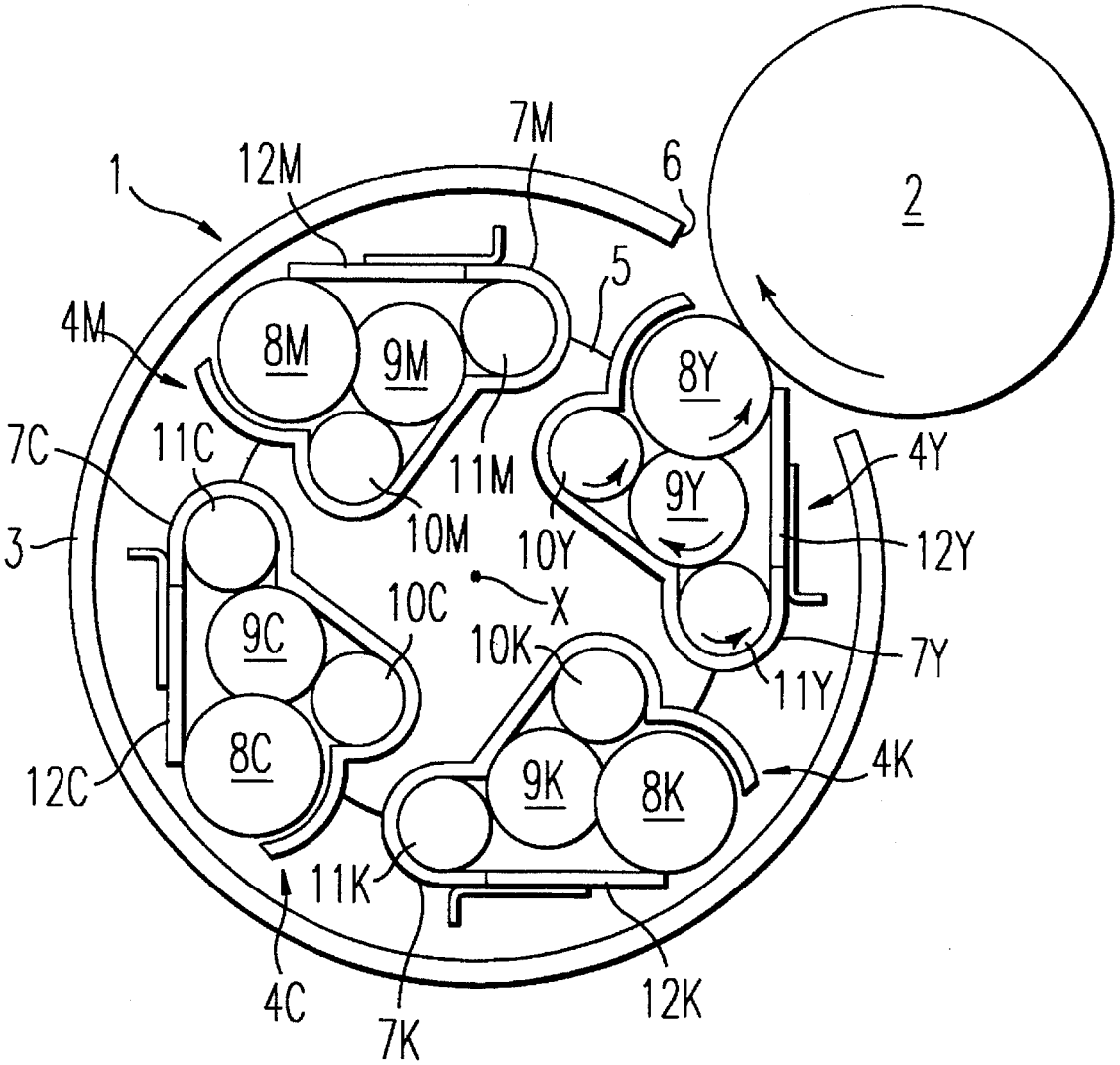
FIG. 1 schematically illustrates a rotary developing device in an image forming apparatus in accordance with the present invention.

Referring to FIG. 1, a rotary developing device 1 is disposed so as to face a photosensitive drum 2 as a latent image carrier. The rotary developing device 1 is a cylindrical housing 3 which is fixedly supported in a housing of an image forming apparatus. A plurality of rotary developing units 4Y, 4M, 4C, 4K are arranged within the rotary developing device 1. These rotary developing units 4Y, 4M, 4C, 4K are supported on a common base member 5. The base member 5 is rotatably driven around an axis X. The respective rotary developing units 4Y, 4M, 4C, 4K are rotated by the rotation of the base member 5. The plurality of the rotary developing units 4Y, 4M, 4C, 4K thus rotate around the common axis.

The rotary developing units 4Y, 4M, 4C, 4K of the rotary developing device 1 respectively accommodate a predetermined powder developer. The predetermined powder developer is either one-component developer or two-component developer. The one-component developer is a toner added to a complementary developer. The two-component developer is a toner mixed with a carrier. In this embodiment of the invention, the one-component developer is used as the powder developer for the respective rotary developing units 4Y, 4M, 4C, 4K.

The image forming apparatus with the above described rotary developing device 1 is a full-color type electrophotographic copying machine. The rotary developing unit 4Y accommodates a toner for yellow color. The rotary developing unit 4M accommodates a toner for magenta color. The rotary developing unit 4C accommodates a toner for cyan color. The rotary developing unit 4K accommodates a toner for black color. As will be described later, to distinguish them from each other, the above stated rotary developing units 4Y, 4M, 4C, 4K are named a yellow rotary developing unit, a magenta rotary developing unit, a cyan rotary developing unit, and a black rotary developing unit. It is preferable that the toner used in these rotary developing units 4Y, 4M, 4C, 4K should be a non-magnetic toner. The toner itself is not shown in FIG. 1.

The photosensitive drum 2 shown in FIG. 1 is rotatably driven in the clockwise direction. The electrostatic latent image for a yellow image is formed on the photosensitive drum 2 after the process of both charging and exposing an image, as is commonly known. As shown in FIG. 1 the yellow rotary developing unit 4Y of the rotary developing units is stopped at the developing position facing the photosensitive drum 2 via an opening 6 of the cylindrical housing 3. The electrostatic latent image formed on the photosensitive drum 2 is then developed or visualized as a toner image for yellow color by the yellow rotary developing unit 4Y.

The toner image for yellow color is transferred to a transfer sheet, not shown. After the photosensitive drum 2 is cleaned, an electrostatic latent image for a magenta color is formed on the photosensitive drum 2. The plurality of rotary developing units 4Y, 4M, 4C, 4K is rotated around the axis X in the clockwise direction. The magenta rotary developing unit 4M of the rotary developing units is stopped at the developing position facing the photosensitive drum 2 via the opening 6 of the cylindrical housing 3. The electrostatic latent image formed on the photosensitive drum 2 is then visualized as a toner image for magenta color by the magenta rotary developing unit 4M.

The toner image for magenta color is transferred to the same location of the transfer sheet on which the toner image for yellow color was transferred.

After the photosensitive drum 2 is cleaned, an electrostatic latent image for a cyan color is formed on the photosensitive drum 2. The plurality of rotary developing units 4Y, 4M, 4C, 4K is rotated around the axis X in the clockwise direction. The cyan rotary developing unit 4C of the rotary developing units is stopped at the developing position facing the photosensitive drum 2 via the opening 6 of the cylindrical housing 3. The electrostatic latent image formed on the photosensitive drum 2 is then visualized as a toner image for cyan color by the cyan rotary developing unit 4C.

The toner image for cyan color is transferred to the same location of the transfer sheet on which the toner images for yellow and magenta color were transferred.

After the photosensitive drum 2 is cleaned, an electrostatic latent image for black color is formed on the photosensitive drum 2. The plurality of rotary developing units 4Y, 4M, 4C, 4K is rotated around the axis X in the clockwise direction. The black rotary developing unit 4K of the rotary developing units is stopped at the developing position facing the photosensitive drum 2 via the opening 6 of the cylindrical housing 3. The electrostatic latent image formed on the photosensitive drum 2 is then visualized as a toner image for black color by the black rotary developing unit 4K.

The toner image for black color is transferred to the same location of the transfer sheet on which the toner images for yellow, magenta, and cyan color were transferred. A full-color image is thus formed on the transfer sheet. A fixing device, not shown, fixes the toner of the full-color image on the transfer sheet.

In the rotary developing device 1, the plurality of rotary developing units is rotated. The respective predetermined rotary developing units are moved to the developing position facing the photosensitive drum 2. The electrostatic latent image formed on the photosensitive drum 2 is visualized as the toner image by the respective rotary developing units.

As shown in FIG. 1, the rotary developing units 4Y, 4M, 4C, 4K are constructed in exactly the same manner as each other and, therefore, the following description of their construction and function will concentrate mainly on the yellow rotary developing unit 4Y. As for the other rotary developing units 4M, 4C, 4K, the structural elements thereof will be designated by the same reference numerals as those of the rotary developing unit 4 except for suffixes "M" "C" and "K". The basic construction and function of the rotary developing units 4M, 4C, 4K is omitted.

The yellow rotary developing unit 4Y has a developing casing 7Y which is fixedly supported on the base member 5. The developing casing 7Y accommodates a developing roller 8Y, toner supplying roller 9Y, a first toner conveying member 10Y, and a second toner conveying member 11Y.

The developing roller 8Y is rotatably supported by both of the side walls of the developing casing 7Y. As shown in FIG. 1, when the rotary developing unit 4Y is moved to the developing position, the developing roller 8Y comes into direct contact with the photosensitive drum 2, or the developing roller 8Y faces the photosensitive drum 2 with a predetermined gap. The developing roller 8Y is driven to rotate in the counter-clockwise direction at the time of the developing operation.

The toner supplying roller 9Y is rotatably supported by both of the side walls of the developing casing 7Y. As shown in FIG. 1, the toner supplying roller 9Y comes into direct contact with the developing roller 8Y with pressure. The toner supplying roller 9Y is driven to rotate in the clockwise direction at the time of the developing operation. The toner for yellow color which is accommodated in the developing casing 7Y is thus supplied and held onto the developing roller 8Y.

The toner is held on the developing roller 8Y. The thickness of the toner layer is restricted by a blade 12Y which is supported in the developing casing 7Y. The toner with a predetermined polarity is carried to the area facing both the developing roller 8Y and the photosensitive drum 2, and electrostatically transferred to the electrostatic latent image formed on the photosensitive drum 2 electrostatically. As described previously, the electrostatic latent image is thus visualized as the toner image.

Figure 2:
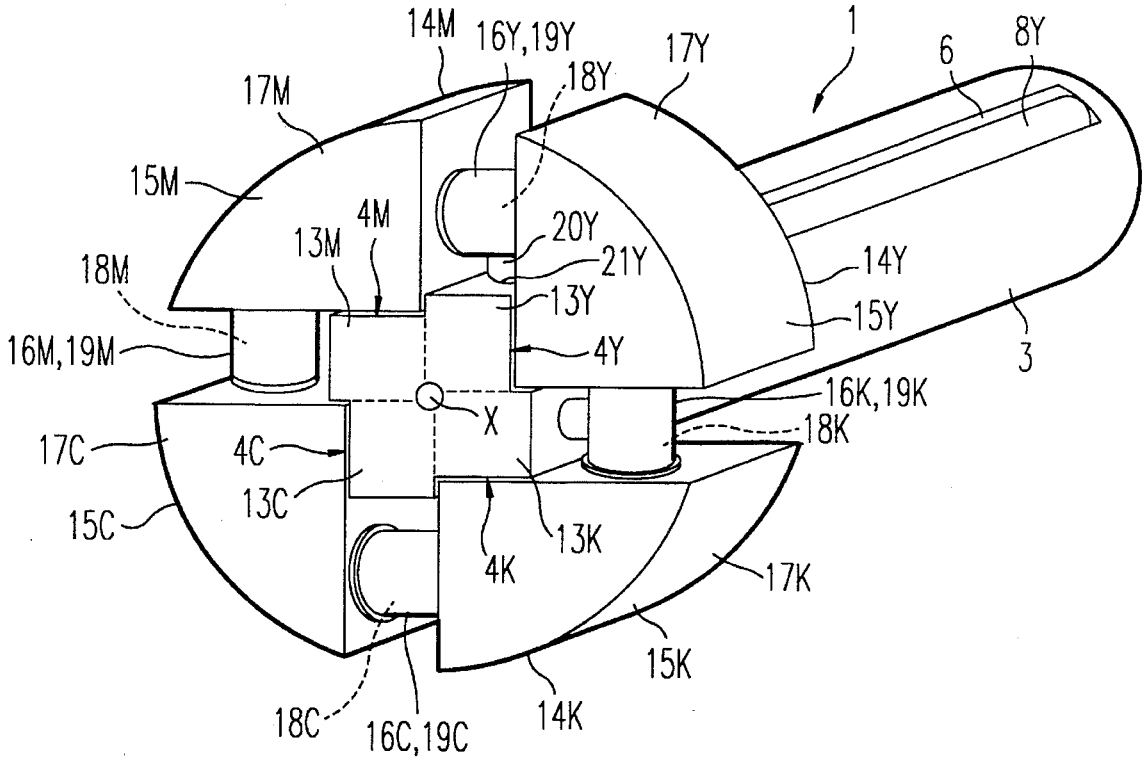
FIG. 2 is a perspective view showing a rotary developing device in an image forming apparatus in accordance with the present invention.

As shown in FIG. 2, the rotary developing unit 4Y has a toner container 13Y which is positioned at one axial end of the cylindrical housing 3. The toner container 13Y is unitarily formed with the developing casing 7Y at an end of the developing casing 7Y corresponding to an axial end of the cylindrical housing 3. The toner container 13Y is also assembled to toner containers 13M, 13C, 13K of the rotary developing units 4M, 4C, 4K. Respective toner containers 13Y, 13M, 13C, 13K are partitioned by walls and are arranged symmetrically at the end of the cylindrical housing 3.

Both the first toner conveying member 10Y and the second toner conveying member 11Y extend from interior of the developing casing 7Y into the toner container 13Y. The first toner conveying member 10Y conveys the toner from the toner container 13Y to the developing casing 7Y by the rotation of the first toner conveying member 10Y. The second toner conveying member 11Y conveys the toner from the developing casing 7Y to the toner container 13Y by the rotation of the second toner conveying member 11Y. The toner is thus circulated between the developing casing 7Y and the toner container 13Y.

As shown in FIG. 1, the outlines of the first toner conveying member 10Y and the second toner conveying member 11Y are shown only by circles. The first toner conveying member 10Y and the second toner conveying member 11Y actually each comprises a spirally-wound wire coil or a spiral feather-shaped wire member forming a screw conveyor.

When developing is performed using the above-mentioned rotary developing units 4Y, 4M, 4C, 4K, the toner is consumed. The toner is supplied from toner cartridges 14Y, 14M, 14C, 14K to the respective rotary developing units 4Y, 4M, 4C, 4K.

Toner cartridges 14Y, 14M, 14C, 14K are installed to the respective rotary developing units 4Y, 4M, 4C, 4K.

As shown in FIG. 2, the toner cartridges 14Y, 14M, 14C, 14K are constructed in exactly the same manner as each other and, therefore, the following description of their construction and function will concentrate mainly on the yellow toner cartridge 14Y. As for the other toner cartridges 14M, 14C, 14K, their structural element will be designated by the same reference numerals as those of the toner cartridge 14 except for suffixes "M" "C" and "K". The basic construction and function of the toner cartridges 14M, 14C, 14K is omitted.

Figure 3:
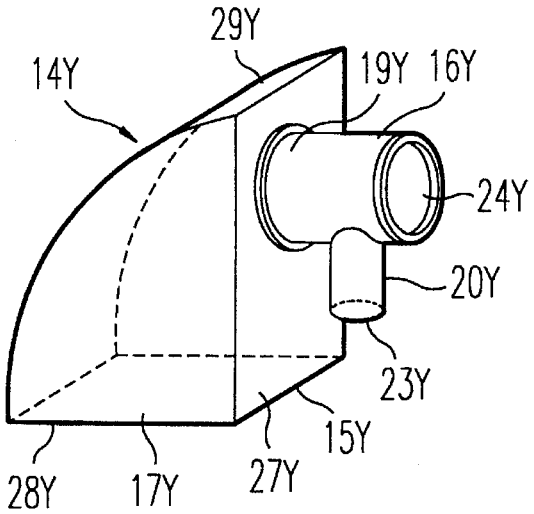
FIG. 3 is a perspective view showing a toner cartridge of the rotary developing device of FIG. 2.

As shown in FIG. 3, 4, 5, the toner cartridge 14Y has a cartridge main body 15Y which accommodates the toner supply, and a connecting member 16Y connecting the cartridge main body 15Y to the rotary developing unit 4Y.

The cartridge main body 15Y has a toner accommodating case 17Y and a cylindrical portion 18Y. The cylindrical portion 18Y connects the inside of the toner accommodating case 17Y to the exterior.

The connecting member 16Y has a cylindrical body 19Y and a divergence tube 20Y. The cylindrical body 19Y is rotationally and tightly engaged with the cylindrical portion 18Y. The divergence tube 20Y is formed unitarily with the cylindrical body 19Y and is branched off from the cylindrical body 19Y at a right angle.

Figure 13:
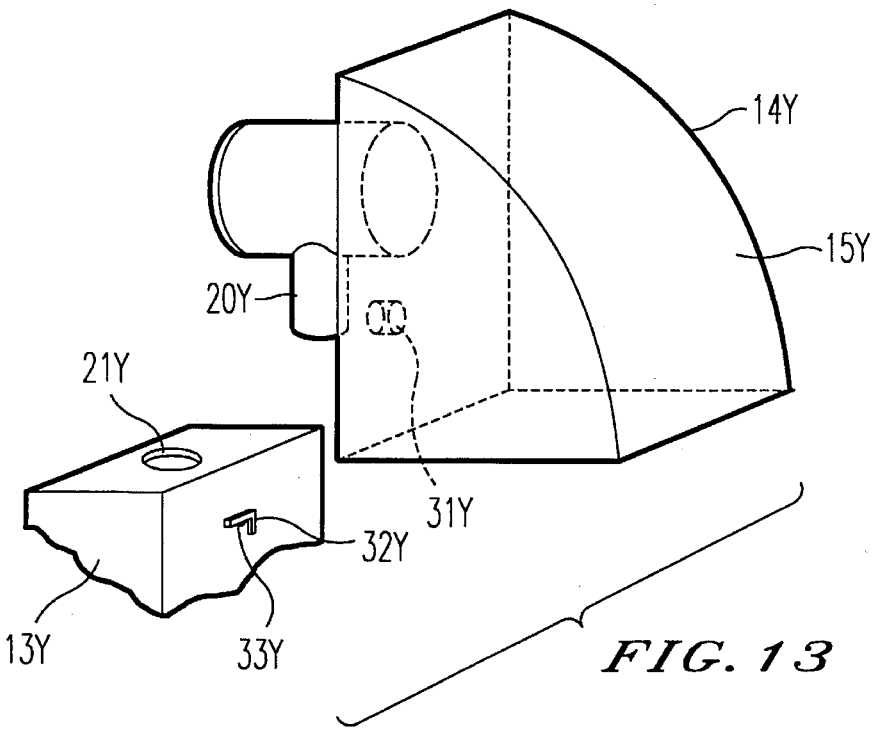
FIG. 13 is a perspective view showing a member for preventing the toner cartridge of the rotary developing device from being removed from the rotary developing units of the rotory developing device.

As shown in FIGS. 2, 13, the divergence tube 20Y is engaged with an opening 21Y formed on the toner container 13Y of the rotary developing unit 4Y. The divergence tube 20Y thus connects to the rotary developing unit 4Y.

The internal diameter of the cylindrical body 19Y of the connecting member 16Y is slightly larger than the external diameter of the cylindrical portion 18Y of the cartridge main body 15Y.

The divergence tube 20Y protrudes in a direction perpendicular to the axis of the cylindrical portion 18Y.

As shown in FIG. 2, 4, an opening 22Y communicates the divergence tube 20Y with the connecting member 16Y and is formed on the cylindrical portion 18Y of the cartridge main body 15Y in order to connect the toner cartridge 14Y with the toner container 13Y of the rotary developing unit 4Y.

The toner accommodated in the toner accommodating case 17Y can flow out to the toner container 13Y of the rotary developing unit 4Y through a path defined by the cylindrical portion 18Y, the opening 22Y formed on the cylindrical portion 18Y, and the divergence tube 20Y.

An edge opening 23Y located at the and of the divergence tube 20Y is constructed as a toner exit for the toner cartridge 14Y.

Figure 4:
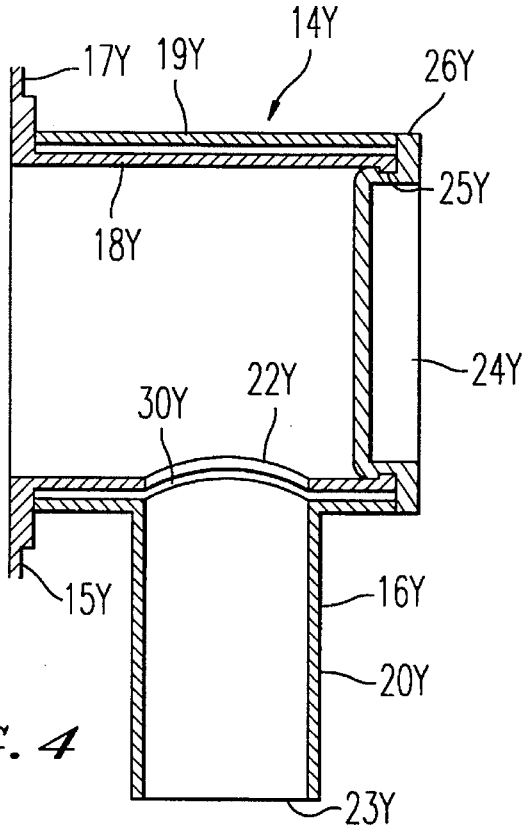
FIG. 4 is a partial cross sectional plan view showing a toner cartridge of the rotary developing device of FIG. 3.
Figure 5:
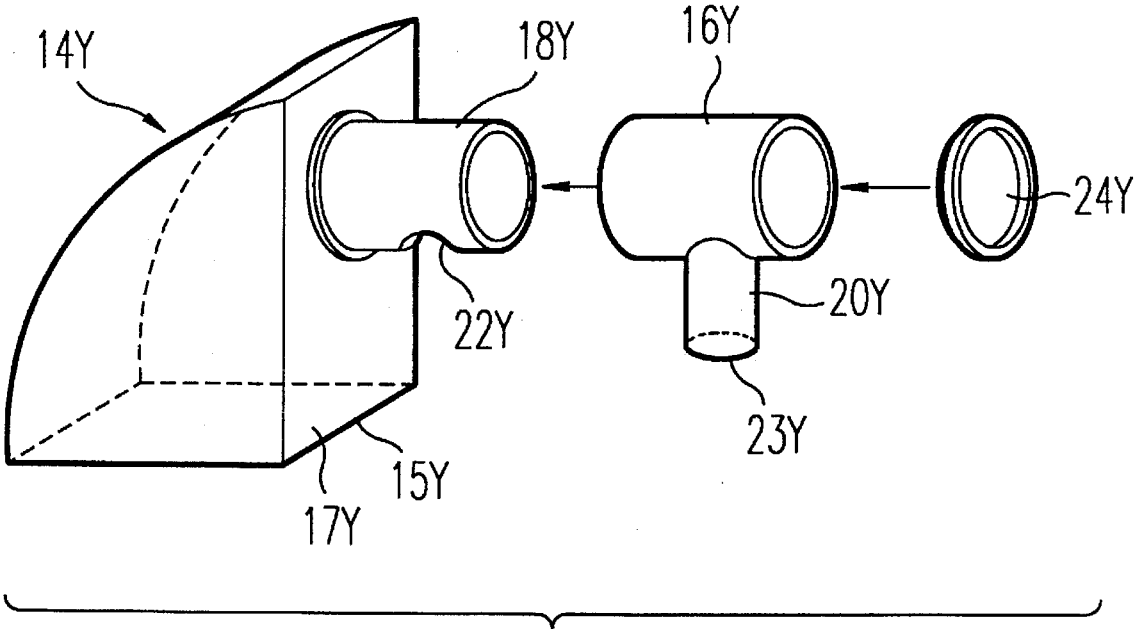
FIG. 5 is a perspective exploded view showing elements of the toner cartridge of the rotary developing device of FIG. 3.

As shown in FIG. 4, the opening located at the end of both the cylindrical portion 18Y and the cylindrical body 19Y is sealed by an attachable/detachable cap 24Y so as to connect the cylindrical portion 18Y with the cylindrical body 19Y.

The cap 24Y is engaged with a ring-shaped projection 25Y formed on the internal surface of the cylindrical portion 18Y of the cartridge main body 15Y. A flange portion 26Y of the cap 24Y comes into direct contact with the edge surface of the cylindrical body 19Y. The cylindrical body 19Y is thus prevented from slipping off in the axial direction of the cylindrical portion 18Y.

The diameter of the flange portion 26Y of the cap 24Y is slightly larger than the internal diameter of the cylindrical body 19Y of the connecting member 16Y. The connecting member 16Y is thus prevented from slipping off the cartridge main body 15Y.

The supply of toner from the toner cartridge 14Y to the toner container 13Y of the rotary developing unit 4Y will be explained hereinafter with reference FIG. 6, 7, 8, 9.

The toner container 13Y is integrally assembled with the developing casing 7Y. The divergence tube 20Y of the toner cartridge 14Y is engaged with the opening 21Y of the toner container 13Y. The toner cartridge 14Y is thus connected with the rotary developing unit 4Y. The other toner containers 13M, 13C, 13K are integrally assembled with the respective developing casings 7M, 7C, 7K. Divergence tubes 20M, 20C, 20K of toner cartridges 14M, 14C, 14K are engaged with the respective openings 21M, 21C, 21K of the toner containers 13M, 13C, 13K. The toner cartridges 14M, 14C, 14K are thus connected with the rotary developing units 4M, 4C, 4K.

These toner cartridges 14Y, 14M, 14C, 14K are supported around the axis X of the plurality of the rotary developing units 4Y, 4M, 4C, 4K.

When the plurality of rotary developing units 4Y, 4M, 4C, 4K is rotated, the respective toner cartridges 14Y, 14M, 14C, 14K connected with these rotary developing units 4Y, 4M, 4C, 4K are also rotated.

Figure 6:
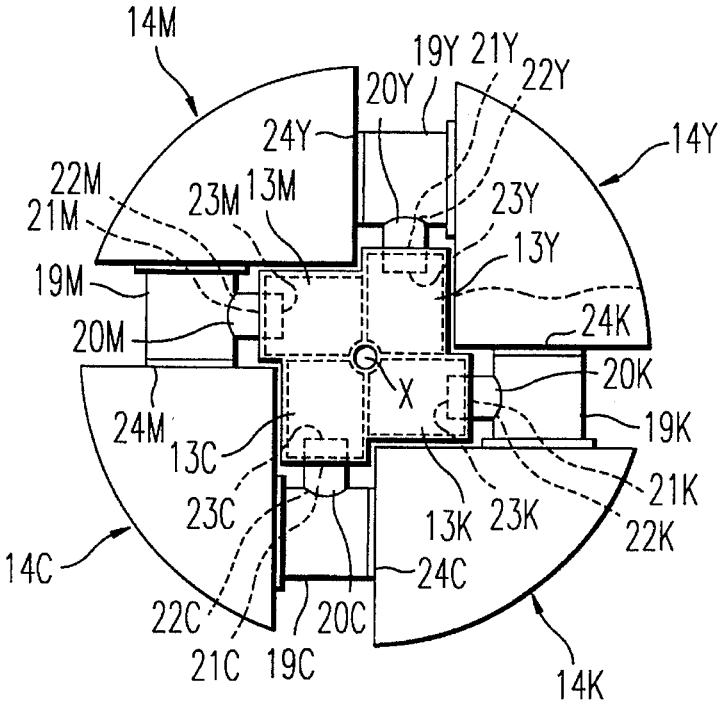
FIG. 6 is an end view showing the toner cartridges of the rotary developing device at the time of developing operation.

The rotation of toner cartridges 14Y, 14M, 14C, 14K is shown in FIG. 6, 7, 8, 9. At the time of rotation of toner cartridges 14Y, 14M, 14C, 14K, the toner accommodated in the respective toner cartridges 14Y, 14M, 14C, 14K is affected and flows by the force of gravity. The toner is thus supplied to the toner container 13Y, 13M, 13C, 13K of the rotary developing units 4Y, 4M, 4C, 4K.

Toner outlets 23Y, 23M, 23C, 23K of the respective toner cartridges 14Y, 14M, 14C, 14K are arranged so as to perform toner supply.

The toner supply operation will be explained in detail with reference to the example of the yellow rotary developing unit 4Y and the toner cartridge 14Y.

Shown in FIG. 6 is the initial position of the toner cartridge 14Y, when the yellow rotary developing unit 4Y is in the developing position. The toner in toner cartridge 14Y is shown by dash lines.

Figure 7:
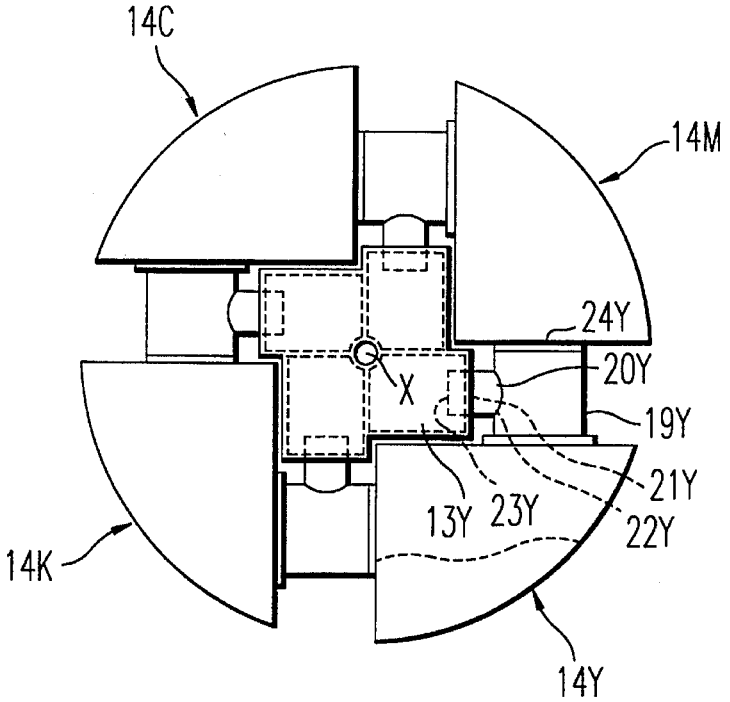
FIG. 7, 8, 9 are views similar to FIG. 6 but showing the rotary developing device during various stages of rotation.
Figure 8:
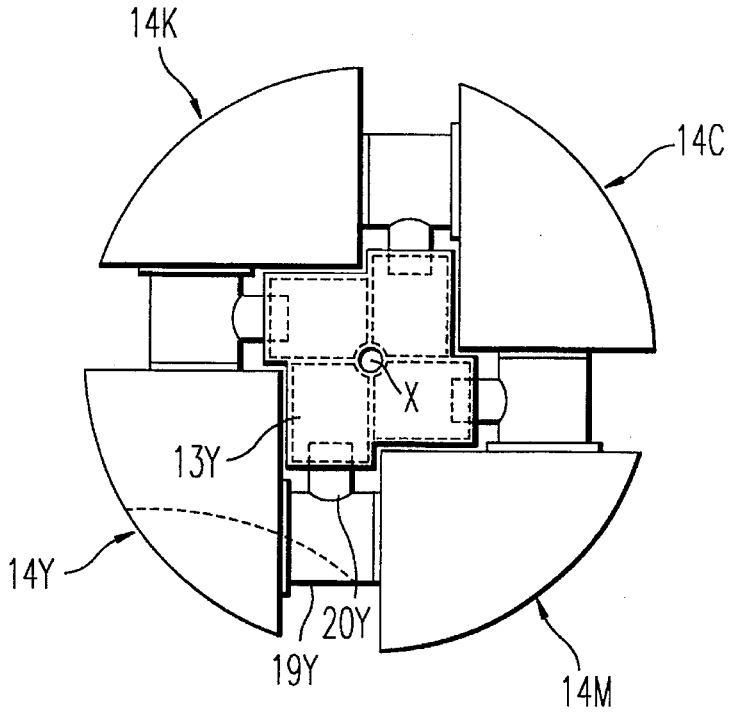
Figure 9:
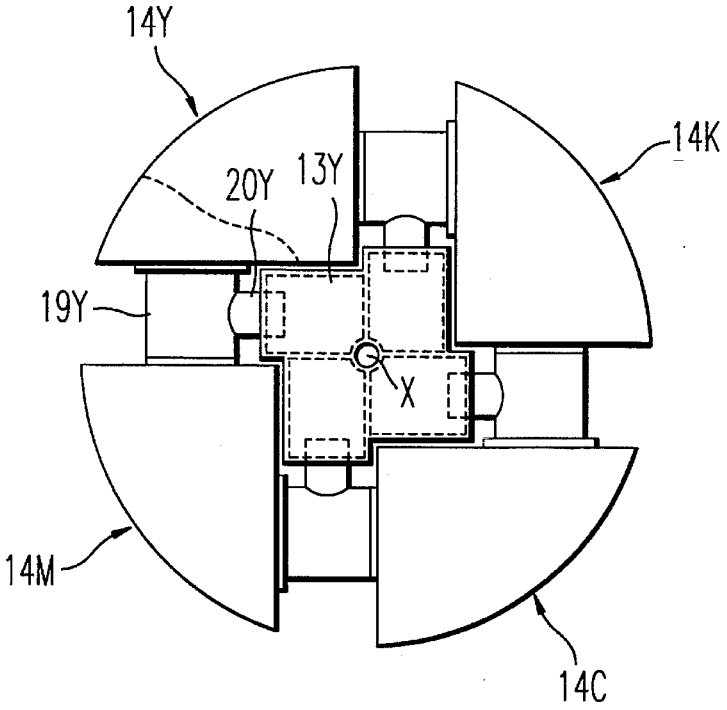

In FIGS. 7, 8, 9 are shown the positions of the toner cartridge 14Y, as the yellow rotary developing unit 4Y is rotated to the non-developing position.

When the toner cartridge 14Y is rotated in the clockwise direction from the position shown in FIG. 6, via the position shown in FIG. 7, to the position shown in FIG. 8, the toner accommodated in the toner cartridge 14Y is indicated by the dash line. The toner accommodated in the toner cartridge 14Y thus falls down and piled up an area of the cylindrical portion 18Y and the cylindrical body 19Y by the force of gravity.

As the rotary developing unit 4Y is further rotated in the clockwise direction, the toner cartridge 14Y is moved to the position shown in FIG. 9.

While the toner cartridge 14Y is rotated from the position shown in FIG. 9 back to the position shown in FIG. 6, the toner which is piled up in the area of the cylindrical portion 18Y and the cylindrical body 19Y falls down from the toner outlet 23Y of the toner cartridge 14Y into the toner container 13Y through the divergence tube 20Y. Upon further rotation of the toner cartridge, the wire coils of the first and second toner conveying members 10Y and 11Y circulate the toner to the rotary developing unit 4Y.

With each rotation of the rotary developing unit 4Y, a suitable amount of the toner accommodated in the toner cartridge 14Y is supplied to the rotary developing unit 4Y. The supplied toner is then conveyed to the developing casing 7Y so as to perform development.

The toner accommodated in the respective toner cartridges 14Y, 14M, 14C, 14K is thus supplied to the respective rotary developing units 4Y, 4M, 4C, 4K by the force of gravity on the toner at the time of the rotation of the toner cartridges 14Y, 14M, 14C, 14K.

It therefore is not necessary to install a separate toner conveying member between the respective toner cartridges 14Y, 14M, 14C, 14K and the corresponding rotary developing units 4Y, 4M, 4C, 4K. Even without installing any separate toner conveying member, the toner can be supplied to the rotary developing units 4Y, 4M, 4C, 4K with no difficulty. As a separate toner conveying member is not installed, it is not necessary to install any driving device for driving the separate toner conveying member.

Therefore, the structure of the rotary developing device can be made smaller and simplified.

Also, the cost of the rotary developing device for image forming apparatus itself can be reduced.

Also, the toner of the rotary developing device for image forming apparatus is not rapidly deteriorated by the moving force of the toner conveying member.

As shown in FIG. 3, the toner accommodating case 17Y of the toner cartridge 14Y has a first wall surface 27Y, a second wall surface 28Y, and a third arcuate wall surface 29Y. The first wall surface 27Y is approximately parallel with the axis of the divergence tube 20Y. The second wall surface 28Y is perpendicular to the first wall surface 27Y. The third wall surface 29Y is an arc-shaped wall surface whose arc is centered on the axis X of the rotary developing units 4Y, 4M, 4C, 4K.

When the rotary developing unit 4Y is rotated, the toner accommodated in the toner accommodating case 17Y is smoothly guided around the arc-shaped third wall surface 29Y so as to move the toner toward the toner outlet 23Y. Without any separate toner conveying member, the toner can thus be securely conveyed to the rotary developing unit 4Y.

The above mentioned explanation applies to the other toner cartridges 14M, 14C, 14K.

As shown in FIG. 2, when the all toner cartridges 14Y, 14M, 14C, 14K are installed in the respective rotary developing units 4Y, 4M, 4C, 4K, the whole structure of the toner cartridges 14Y, 14M, 14C, 14K and the toner containers 13Y, 13M, 13C, 13K is approximately a cylindrical shape.

Since the diameter of the respective toner cartridges 14Y, 14M, 14C, 14K is substantially constant at any rotational angle, the space required for the respective toner cartridges 14Y, 14M, 14C, 14K is minimized. The size of the rotary developing device 1 is also minimized.

If the structure of the toner cartridges 14Y, 14M, 14C, 14K and the toner containers 13Y, 13M, 13C, 13K was not approximately cylindrical in shape but approximately rectangular shape in shape, when the toner cartridges 14Y, 14M, 14C, 14K and the toner containers 13Y, 13M, 13C, 13K are rotated, they draw a large orbit. A large accommodating space for the toner cartridges 14Y, 14M, 14C, 14K is therefore needed and the size of the rotary developing device 1 becomes large. The embodiment shown in FIG. 1 to 9 avoids this problem.

When the rotary developing device 1 is operated for a long period, the toner accommodated in the toner cartridges 14Y, 14M, 14C, 14K is consumed and the toner cartridges 14Y, 14M, 14C, 14K become empty. In such a condition, the empty cartridges 14Y, 14M, 14C, 14K must be replaced with new toner cartridges which accommodate fresh toner.

The replacement operation will be described hereinafter with reference to the toner cartridge 14Y of the yellow rotary developing unit 4Y.

When the toner accommodated in the toner cartridge 14Y is consumed or the amount of the remaining toner becomes small, a sensor (not shown) installed either inside or outside of the toner cartridge 14Y detects this condition. A display panel (not shown) installed in the image forming apparatus displays an indication for replacing the toner cartridge 14Y.

Figure 10:
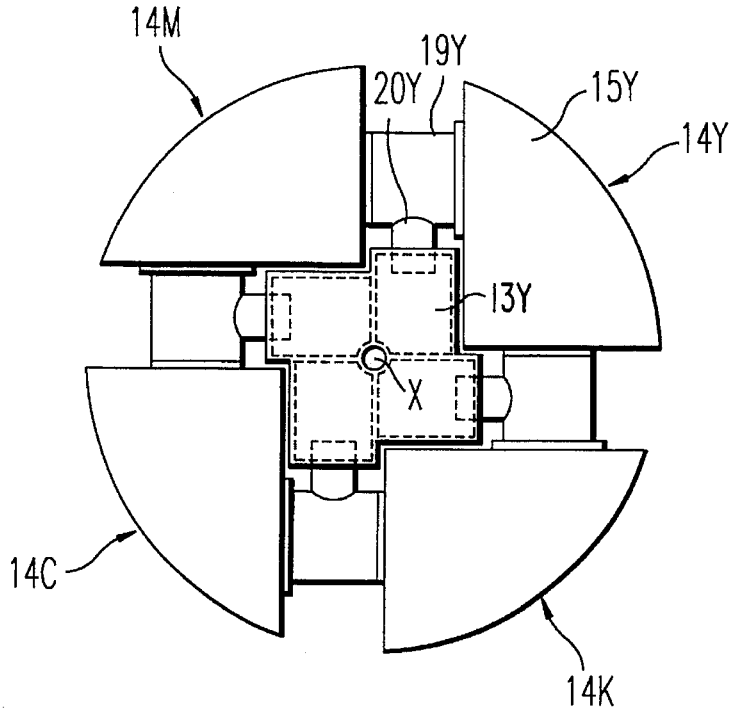
FIG. 10, 11, 12 are views showing a technique for removing the toner cartridge of the rotary developing device from the rotary developing units of the rotary developing device and for attaching the toner cartridge of the rotary developing device to the rotary developing units of the rotary developing device.
Figure 11:
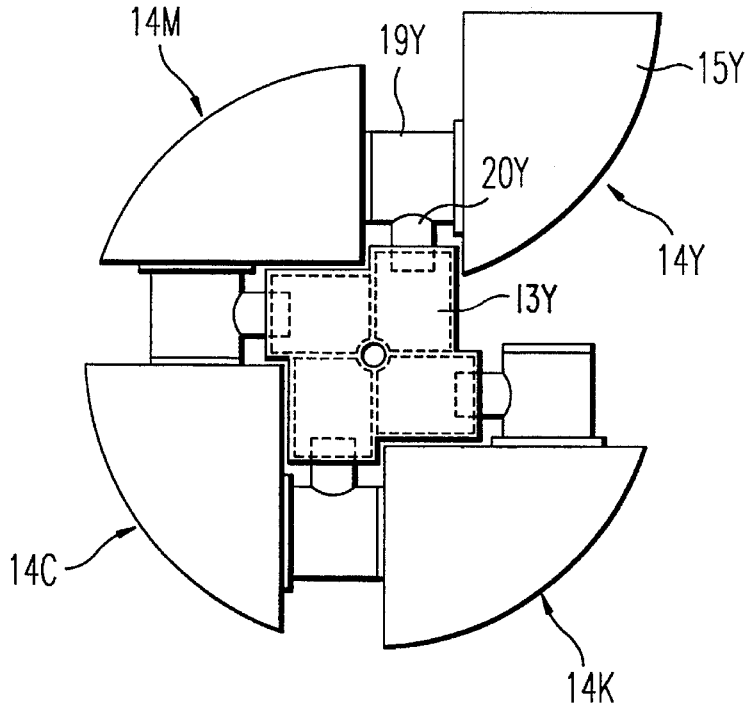

As shown in FIG. 10, and 11, the operator rotates the cartridge main body 15Y of the toner cartridge 14Y by 180 degrees upward. The cylindrical portion 18Y of the cartridge main body 15Y is still engaged with the cylindrical body 19Y of the connecting member 16Y. The cartridge main body 15Y is rotated by 180 degrees around the internal surface of the cylindrical body 19Y.

This rotation moves the divergence tube 20Y out of alignment with the opening 22Y formed on the cylindrical portion 18Y. The divergence tube 20Y is thus sealed by the wall surface of the cylindrical portion 18Y.

Therefore, the interior of the toner cartridge 14Y is sealed by the wall surface and the toner flow path is closed. Even if a small amount of toner remains within of the toner cartridge 14Y, the toner will not be scattered from the toner outlet 23Y to outside.

The diameter of the opening 22Y is determined so that the divergence tube 20Y is sealed by the wall surface of the cylindrical portion 18Y and the internal portion of the toner cartridge 14Y is sealed by the wall surface due to relative rotation of the cylindrical portion 18Y and the cylindrical body 19Y from the state of alignment of the divergence tube 20Y with the opening 22Y.

Figure 12:
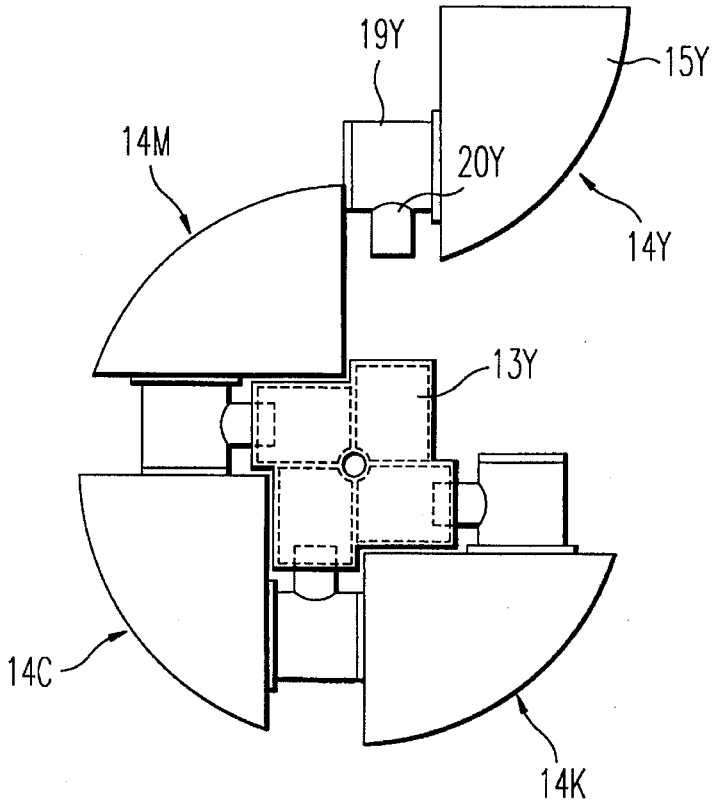

As shown in FIG. 11, and 12, the toner cartridge 14Y in the state of FIG. 11 is lifted upward. The divergence tube 20Y is then taken out from the opening 21Y of the toner container 13Y. The toner cartridge 14Y is thus detached from the rotary developing unit 4Y. Since the toner cartridge 14Y in the state of FIG. 12 is sealed, the toner will not be scattered.

The new toner cartridge 14Y can be installed to the rotary developing unit 4Y by a reverse procedure of the above stated procedure. In this case, the divergence tube 20Y is tightly engaged with the opening 21Y of the rotary developing unit 4Y. Before the cartridge main body 15Y is rotated by 180 degrees, the divergence tube 20Y is sealed by the wall surface of the cylindrical portion 18Y. The toner is therefore not scattered from the toner cartridge 14Y. The toner-replacement operation can thus be performed without staining the surroundings with toner. The cartridge main body 15Y in the state of FIG. 11 is rotated to the state of FIG. 10 by 180 degrees. This rotation aligns the divergence tube 20Y with the opening 22Y. The fresh toner accommodated in the toner cartridge 14Y then flows out from the toner outlet 23Y.

The toner-replacement operation without scattering the toner can thus be easily performed. The number of parts of the toner cartridges 14Y, 14M, 14C, 14K can be reduced and the production cost of the toner cartridges 14Y, 14M, 14C, 14K can also be reduced.

As shown in FIG. 4, a ring-shaped sealing member 30Y which is a resilient material such as sponge is attached around the opening 22Y formed on the cylindrical portion 18Y. The divergence tube 20Y is thus tightly sealed by the wall surface of the cylindrical portion 18Y. The leakage of the toner accommodated in the toner cartridge 14Y is thus securely prevented.

As shown in FIG. 2, when the toner cartridge 14Y is connected with the rotary developing unit 4Y, the alignment of the divergence tube 20Y and the opening 22Y is maintained. The toner accommodated in the toner cartridge 14Y can then flow out from the toner outlet 23Y. In this state, if the operator unintentionally detaches the toner cartridge 14Y from the rotary developing unit 4Y, the toner is scattered from the toner outlet 23Y and stains surroundings.

A toner cartridge retaining member is installed in the rotary developing device, the toner cartridge retaining member prevents the toner cartridge 14Y from separating from the rotary developing unit 4Y when the toner can flow out from the toner outlet 23Y to outside.

As shown in FIG. 13, 14, the toner cartridge member has a projection 31Y, an L-shaped guiding member 32Y, and a resilient member such as a plate spring 33Y. The projection 31Y is formed on the cartridge main body 15Y of the toner cartridge 14Y. The L-shaped guiding member 32Y is formed on the toner container 13Y. One end of the plate spring 33Y is engaged with the L-shaped guiding member 32Y.

When the operator installs the toner cartridge 14Y to the rotary developing unit 4Y, the divergence tube 20Y is engaged with the opening 21Y of the rotary developing unit 4Y, and the cartridge main body 15Y is rotated.

Figure 14:
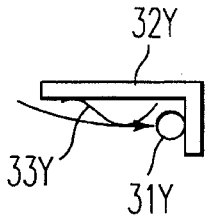
FIG. 14 is a partial enlarged view of FIG. 13.

At the time of this rotational movement, as shown in FIG. 14, the projection 31Y protrudingly disposed on the cartridge main body 15Y resiliently deforms the plate spring 33Y and engages the guiding member 32Y.

Therefore, the projection 31Y is locked by the plate spring 33Y. As shown in FIG. 4, at this time the divergence tube 20Y is aligned with the opening 22Y. When the operator then tries to lift the toner cartridge 14Y upward, the projection 31Y collides with the guiding member 32Y. The operator therefore cannot detach the toner cartridge 14Y from the rotary developing unit 4Y.

When the cartridge main body 15Y is rotated in the direction opposite to that of FIG. 14 while resiliently deforming the plate spring 33Y, the divergence tube 20Y is sealed by the wall surface of the cylindrical portion 18Y and the projection 31Y is released from the guiding member 32Y. The operator can therefore detach the toner cartridge 14Y from the rotary developing unit 4Y.

Since the toner cartridge 14Y is sealed, the toner is not scattered from the toner outlet 23Y and does not stain surroundings. When the operator performs misoperation in attaching/detaching the toner cartridges 14Y, 14M, 14C, 14K, the problem of scattering the toner can be avoided.

Other engaging members besides the projection 31Y and the guiding member 32Y stated above may be disposed on both the toner cartridge 14Y and the rotary developing unit 4Y.

Accordingly, the operator cannot detach the toner cartridge 14Y from the rotary developing unit 4Y, due to the engagement of the engaging members at the time when the toner accommodated in the toner cartridge 14Y can flow out from the toner outlet 23Y to outside.

Recently protection of the environment has been emphasized. Recycling various kinds of mechanical equipment is therefore demanded. Therefore, it is preferable that the toner cartridge should be made not for one-time usage but for multiple usage. For this, the cap 24Y is detachably disposed on the toner cartridge 14Y of the rotary developing device 1. After the toner cartridge 14Y is detached from the rotary developing unit 4Y, the cap 24Y shown in FIG. 4, which is tightly inserted to the cylindrical portion 18Y, is detached from the cylindrical portion 18Y.

Then, toner is refilled into the toner cartridge 14Y through the cylindrical portion 18Y.

Again, the cap 24Y is tightly inserted into the cylindrical portion 18Y so as to seal the interior of the toner cartridge 14Y. The toner cartridge 14Y is then installed on the rotary developing unit 4Y. In such a way, the toner cartridge 14Y can be used for multiple usage.

The rotary developing device in which the respective rotary developing units 4Y, 4M, 4C, 4K with the toner containers 13Y, 13M, 13C, 13K are disposed is explained above in detail.

This invention can also apply to any type of rotary developing device in which the toner is supplied from the respective toner cartridges 14Y, 14M, 14C, 14K to the respective developing casing 7Y, 7M, 7C, 7K without any toner container.

This invention is not restricted to the above stated embodiment, such as the number of rotary developing units, or the color of the toner used in the rotary developing units. These can be modified by design choice.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A rotary developing device for an image forming apparatus having a latent image carrier, comprising:

a plurality of rotary developing units supported so as to rotate about a common axis so that each of said rotary developing units can be rotated to face the latent image carrier to develop an image on the latent image carrier; and a plurality of toner cartridges connected to said plurality of rotary developing units so as to supply toner to said rotary developing units, wherein each of said toner cartridges includes a cartridge main body for accommodating toner and a toner outlet through which toner can flow to reach a respective one of said rotary developing units, and wherein each of said toner outlets is disposed on a respective one of said toner cartridges such that toner in the cartridge main body of each respective toner cartridge is discharged therefrom and through the respective toner outlet entirely by gravity acting on the toner when said plurality of toner developing units is rotated about said common axis.

2. The rotary developing device of claim 1, wherein each of said toner cartridges comprises a cartridge main body, said cartridge main bodies each having an arcuate wall centered on said common axis so that a radially outer periphery of said plurality of toner cartridges has a substantially constant diameter.

3. The rotary developing device of claim 1, wherein each of said toner cartridges comprises:

a cartridge main body for accommodating toner; and a connecting member pivotally connected to said cartridge main body and providing a path for communication of the toner in said cartridge main body with the toner outlet.

4. The rotary developing device of claim 3, wherein each said cartridge main body includes a cylindrical portion, and wherein each said connecting member comprises a cylindrical body rotatably mounted to said cylindrical portion of said cartridge main body.

5. The rotary developing device of claim 4, wherein each said connecting member further comprises a divergence tube extending from said cylindrical body and connectable to a respective one of said rotary developing units, wherein said cylindrical portion has an opening, which aligns with said divergence tube to open the path for communication of the toner in the respective cartridge main body, when said cylindrical body is at a rotational position on said cylindrical portion such that said divergence tube connects to the respective one of said rotary developing units.

6. The rotary developing device of claim 5, wherein said cylindrical body seals said opening of said cylindrical portion to close the path for communication of the toner in the respective main body when said cylindrical body is at a rotational position on said cylindrical portion such that said divergence tube does not connect to the respect one of said rotary developing units.

7. The rotary developing device of claim 6, including a toner cartridge retaining member for each of said toner cartridges, each of said retaining members preventing the respective toner cartridge from being removed from the rotary developing device when said cylindrical body is rotated to a rotational position such that said opening of said cylindrical portion is aligned with said divergence tube to open the path for communication of the toner in the respective cartridge main body.

8. The rotary developing device of claim 4, wherein each said cylindrical portion and cylindrical body mounted thereto define an axial end opening through which toner may be introduced into the respective cartridge main body, further comprising a removable cap covering said axial end opening.

9. The rotary developing device of claim 8, wherein said cap includes means for retaining said cylindrical body on said cylindrical portion.

10. The rotary developing device of claim 4, wherein each said cartridge main body includes a toner accommodating case, said toner accommodating case having an arcuate wall and two planar walls intersecting said arcuate wall, wherein said cylindrical portion extends from one of said planar walls.

11. A rotary developing device for an image forming apparatus having a latent image carrier, comprising:

a plurality of rotary developing units supported so as to rotate about a common axis so that each of said rotary developing units can be rotated to face the latent image carrier to develop an image on the latent image carrier; and a plurality of independent toner cartridges connected to said plurality of rotary developing units so as to supply toner to said rotary developing units, wherein each of said toner cartridges includes a cartridge main body for accommodating toner and a connecting member pivotally connected to said cartridge main body and providing a path for communication of the toner in said cartridge main body with a toner outlet through which toner can flow to reach a respective one of said rotary developing units when said plurality of toner developing units is rotated about said common axis.

12. The rotary developing device of claim 11, wherein each said cartridge main body includes a cylindrical portion, and wherein each said connecting member comprises a cylindrical body rotatably mounted to said cylindrical portion of said cartridge main body.

13. The rotary developing device of claim 12, wherein each said connecting member further comprises a divergence tube extending from said cylindrical body and connectable to a respective one of said rotary developing units, wherein said cylindrical portion has an opening, which aligns with said divergence tube to open the path for communication of the toner in the respective cartridge main body, when said cylindrical body is at a rotational position on said cylindrical portion such that said divergence tube connects to the respective one of said rotary developing units.

14. The rotary developing device of claim 13, wherein said cylindrical body seals said opening of said cylindrical portion to close the path for communication of the toner in the respective main body when said cylindrical body is at a rotational position on said cylindrical portion such that said divergence tube does not connect to the respect one of said rotary developing units.

15. The rotary developing device of claim 14, including a toner cartridge retaining member for each of said toner cartridges, each of said retaining members preventing the respective toner cartridge from being removed from the rotary developing device when said cylindrical body is rotated to a rotational position such that said opening of said cylindrical portion is aligned with said divergence tube to open the path for communication of the toner in the respective cartridge main body.

16. The rotary developing device of claim 12, wherein each said cylindrical portion and cylindrical body mounted thereto define an axial end opening through which toner may be introduced into the respective cartridge main body, further comprising a removable cap covering said axial end opening.

17. The rotary developing device of claim 16, wherein said cap includes means for retaining said cylindrical body on said cylindrical portion.

18. The rotary developing device of claim 12, wherein each said cartridge main body includes a toner accommodating case, said toner accommodating case having an arcuate wall and two planar walls intersecting said arcuate wall, wherein said cylindrical portion extends from one of said planar walls.

* * * * *